US005598823A

United States Patent [19]

Povinger

[11] Patent Number: 5,598,823

[45] Date of Patent: Feb. 4, 1997

[54] PRESSURE RESPONSIVE SHUT-OFF DEVICE

[75] Inventor: Bela P. Povinger, Grosse Ile, Mich.

[73] Assignee: Ford Motor Company, Dearborn, Mich.

[21] Appl. No.: 465,297

[22] Filed: Jun. 5, 1995

[51] Int. Cl.[6] ..... F02M 37/04

[52] U.S. Cl. ..... 123/463; 123/198 D

[58] Field of Search ..... 123/463, 382, 123/383, 198 D, 467

[56] References Cited

U.S. PATENT DOCUMENTS

| | | | |
|---|---|---|---|
| 1,955,037 | 4/1934 | Viel | 123/463 |
| 2,330,650 | 9/1943 | Weiche | 123/463 |
| 2,429,322 | 10/1947 | Lee | 123/463 |
| 3,112,764 | 12/1963 | Anderson et al. . | |
| 3,351,087 | 11/1967 | Welty . | |
| 3,960,127 | 6/1976 | Vuaille | 123/383 |
| 4,050,431 | 9/1977 | Jackson | 123/463 |
| 5,101,793 | 4/1992 | Sample . | |

FOREIGN PATENT DOCUMENTS 623186 9/1978 U.S.S.R. .

*Primary Examiner*—Carl S. Miller
*Attorney, Agent, or Firm*—Paul K. Godwin

[57] ABSTRACT

A flow of fuel is prevented from entering the intake manifold via the manifold vacuum passage in a fuel injection system having a source of liquid fuel under pressure in fluid communication with a least one fuel injector 28 mounted in an engine intake manifold 20 and a pressure regulator 68 having a first pressure chamber 82 in fluid communication with the source of pressurized fuel, a second pressure chamber 84 in fluid communication with the intake manifold 20, and a diaphragm 86 sealingly engaged therebetween for maintaining a predetermined pressure differential between the pressure chambers by an apparatus 78 operatively connected between the second pressure chamber 84 and the intake manifold 20 which prevents the flow of fuel from the second pressure chamber 84 to the intake manifold 20 in response to a pressure differential between the second pressure chamber 84 and the intake manifold 20 above a predetermined value.

20 Claims, 1 Drawing Sheet

PRESSURE RESPONSIVE SHUT-OFF DEVICE

BACKGROUND OF THE INVENTION

The invention relates generally to controlling fuel flow in a fuel injection system, and more particularly to an apparatus for preventing flow of fuel to the intake manifold via the manifold vacuum passage.

Most port or throttle body fuel injection systems include a fuel pressure regulator which controls the fuel pressure supplied to the fuel injectors. The pressure regulator may be a diaphragm-operated relief valve in which one side of the diaphragm is subject to liquid fuel pressure and the other side is subject to intake manifold vacuum. The nominal fuel pressure is established by a spring preload applied to the diaphragm. Varying the force on one side of the diaphragm with manifold pressure maintains the desired fuel pressure at the injectors. Fuel in excess of that used by the engine is bypassed through the regulator and returned to the fuel tank.

A problem, recognized by the inventor herein and not addressed in the prior art, is that should the fuel/vacuum barrier established by the diaphragm be breached, relatively high pressure liquid fuel would be delivered to the intake manifold through the manifold vacuum passage. Under such conditions, the increased fuel-to-air ratio would cause the engine to run rich of stoichiometry.

SUMMARY OF THE INVENTION

An object of the invention herein, is to prevent a flow of fuel to the intake manifold via the manifold vacuum passage in the event a diaphragm failure occurs in a fuel pressure regulator. The above object is achieved, and problems of prior approaches are overcome in the present invention. The invention is embodied, in a fuel injection system having a source of liquid fuel under pressure in fluid communication with a least one fuel injector mounted in an engine intake manifold and a pressure regulator having a first pressure chamber in fluid communication with the source of pressurized fuel, a second pressure chamber in fluid communication with the intake manifold, and a diaphragm sealingly engaged therebetween for maintaining a predetermined pressure differential between the pressure chambers. The invention includes by an apparatus operatively connected between the second pressure chamber and the intake manifold to prevent a flow of fuel through the second pressure chamber to the intake manifold in response to a reduction in the pressure differential below a predetermined value. Such reduction can occur when the diaphragm develops a leak that allows fuel to pass from the first to the second pressure chamber. This causes an instantaneous or rapid increase in the differential pressure between the second chamber and the intake manifold.

An advantage of the present invention is that fuel is prevented from flowing through the manifold vacuum passage to the intake manifold. Another advantage is that excess liquid fuel is not introduced into the intake manifold.

BRIEF DESCRIPTION OF THE DRAWINGS

The above object and advantages of the invention will be more clearly understood by reading the following description of an examplary embodiment in which the invention is used to advantage with reference to the attached drawings wherein.

DESCRIPTION OF AN EMBODIMENT

Figure 1:
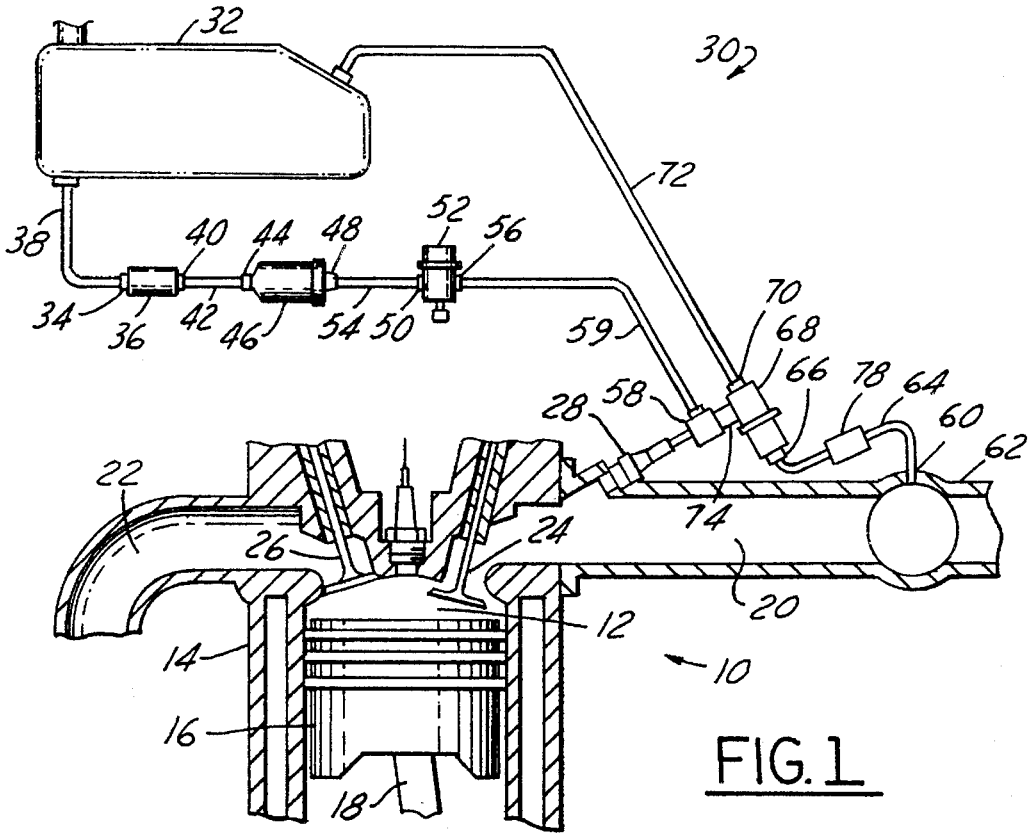
FIG. 1 is a diagrammatic partial cross-sectional view of an embodiment wherein the invention is used to advantage.

One cylinder of internal combustion engine 10, which comprises a plurality of cylinders, is shown in FIG. 1. Engine 10 includes combustion chamber 12 and cylinder walls 14 with piston 16 positioned therein and connected to a crankshaft (not shown) by connecting rod 18. Combustion chamber 12 is shown communicating with intake manifold 20 and exhaust manifold 22 via respective intake valve 24 and exhaust valve 26. Preferably intake manifold 20 communicates with a conventional throttle body (not shown) via a throttle plate (also not shown), or alternative throttle mechanisms as are known in the art. Intake manifold 20 is shown having fuel injector 28 coupled thereto for delivering liquid fuel to combustion chamber 12.

According to the present invention, fuel is delivered to fuel injector 28 by fuel supply system 30 which includes fuel tank 32 fluidly interconnected with inlet 34 of fuel pump 36 through suction line 38. Pressurized fuel is discharged from outlet 40 of fuel pump 36 through outlet line 42 to inlet 44 of fuel filter 46 which is configured to remove particulate contaminants from the fuel in a known manner. Outlet 48 of fuel filter 46 is illustrated in FIG. 1 as being fluidly interconnected with inlet 50 of fuel pressure damper 52 through fluid line 54. Preferably, pressure damper 52 is a pressure accumulator operative to reduce transient pressure fluctuations induced by fuel pump 36 and the opening and closing of fuel injector 28. The outlet 56 of damper 52 is fluidly connected to fuel rail 58 by line 59. Fuel rail 58, in turn, provides pressurized fuel to fuel injector 28.

Continuing with FIG. 1, a vacuum take-off port 60 is formed through a wall 62 of intake manifold 20 for fluidly connecting intake manifold 20 through vacuum passage 64 to vacuum port 66 of pressure regulator 68 as will be described later herein with reference to FIG. 2. Pressure regulator 68 also includes fuel outlet 70 which is fluidly connected to fuel tank 30 by return line 72. Finally, pressure regulator 68 is illustrated diagrammatically in FIG. 1 as including mounting block 74. Pressure regulator 68 is mounted to block 74 in a known manner to provide fluid communication between pressure regulator 68 and fuel rail 58 via fuel inlet 76 (see FIG. 2). Most importantly, according to the preferred embodiment, a pressure responsive blocking device 78 is positioned fluidly intermediate vacuum take-off port 60 of intake manifold 20 and vacuum port 66 of pressure regulator 68. An advantage is thereby obtained of preventing direct fluid communication between vacuum port 66 of pressure regulator 68 and intake manifold 20 under certain unintended operating conditions of the pressure regulator.

Figure 2:
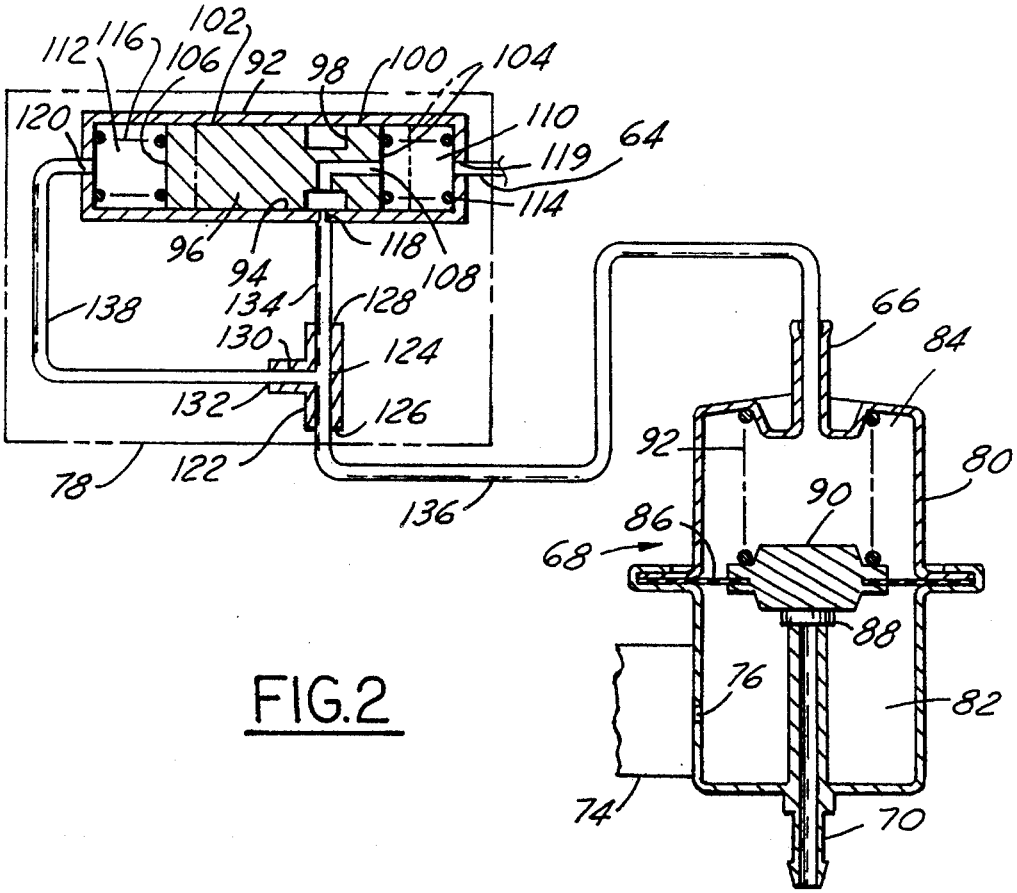
FIG. 2 is an enlarged diagrammatic cross-section view of a portion of the embodiment shown in FIG. 1.

Referring now to FIG. 2, pressure regulator 68 in the present embodiment consists of a housing 80 which is divided into pressure chambers 82 and 84 by diaphragm 86 illustrated here as a resilient elastomeric member. Fuel chamber 82 is in fluid communication with fuel pump 36, and vacuum chamber 84 is in fluid communication with intake manifold 20. During normal operation, fuel pressure regulator 68 functions as a diaphragm-operated relief valve in which one side of diaphragm 86 is subject to liquid fuel pressure and the other side is subject to the sum of spring pressure and intake manifold vacuum. Valve 88 is mounted on one side of diaphragm 86 to engage valve seat 90. Compression spring 92 preloads the other side of diaphragm 86. The variations in manifold pressure communicated to one side of diaphragm 86 maintains the desired fuel pressure at fuel injector 28. When the preset pressure is exceeded, valve 88 separates from valve seat 90 and allows excess fuel to return to fuel tank 32 through return line 72.

A particular embodiment of pressure responsive blocking device 78 will now be described with continued reference to FIG. 2. Generally, pressure responsive blocking device 78 operates as a valve arranged fluidly in series between vacuum chamber 84 and intake manifold 20. As specifically illustrated in FIG. 2, pressure responsive blocking device 78 includes a housing 92 with a cylindrical cavity 94 formed therein.

A valve member, such as spool member 96, is slidably positioned within cavity 94. Annulus 98 preferably separates spool member 96 into seal lands 100 and 102 between ends 104 and 106, respectively. Spool member 96 further includes internal passage 108 which provides fluid communication between end 104 and annulus 98.

Actuator chambers 110 and 112 are defined in cavity 94 by ends 104 and 106 of spool member 96 and the respective interior walls of housing 92. Springs 114 and 116 are disposed in actuator chambers 110 and 112, respectively, to position spool member 96 in an open position wherein annulus 98 communicates with restricted flow port 118 of housing 92 which is in fluid communication with vacuum chamber 84 of pressure regulator 68. Actuator chamber 110 is in fluid communication with intake manifold 20 through port 119 in housing 92. Actuator chamber 112 is in fluid communication with vacuum chamber 84 through port 120. Also, when spool member 96 is in the open position, as shown in FIG. 2, actuator chamber 110 is in fluid communication with actuator chamber 112 in parallel fashion.

The exact configuration of the fluid paths between ports 118, 119 and 120, vacuum chamber 84, and intake manifold 20 is a matter of design choice. However, restricted flow port 118 and port 120 should be in parallel fluid communication with vacuum chamber 84. As illustrated in FIG. 2, for example, the parallel flow paths are provided through vacuum distributor 122. This T-shaped fitting has an internal longitudinal main bore 124 extending from a lower end 126 through its upper end 128 and a lateral bore 130 extending through sidewall 132 into main bore 124. Restricted flow port 118 fluidly communicates with vacuum chamber 84 via lines 134 and 136 and main bore 124. Pore 120 fluidly communicates with vacuum chamber 84 via lines 138 and 136, main bore 124, and lateral bore 130. Other configurations will certainly come to the minds of those skilled in the art. For example, the T fitting of the presently described embodiment could be eliminated by directly coupling each of the ports to the vacuum chamber. However, an advantage of the above described embodiment is that it is easily coupled to a conventional fuel pressure regulator without requiring modifications.

Another aspect of the presently described embodiment of blocking device 78, which will be discussed in greater detail later herein, is that the flow rate through restricted flow port 118 is less than the flow rate through port 120. This flow restriction can be accomplished by making the diameter of port 118 smaller than that of port 120 (as shown in FIG. 2). Alternatively, the flow restriction can be accommodated in the T-fitting of the presently described embodiment.

The operation of the fuel injection system above will now be described with particular reference to FIG. 2. Liquid fuel under pressure is conducted by fuel pump 36 through fuel filter 46, fuel pressure damper 52, and fuel rail 58 to fuel pressure regulator 68. Accordingly, fuel chamber 82 of pressure regulator 68 is at fuel pump outlet pressure. Springs 114 and 116 and equal pressure in actuator chambers 110 and 112 balance spool member 96 in the open position. Accordingly, spool member 96 remains in the open position thereby effecting fluid communication between vacuum chamber 84 and intake manifold 20 through actuator chamber 110, internal passage 108 to annulus 98 and restricted flow port 118 to vacuum port 66 of regulator 68.

In the event that the fuel/vacuum barrier established by diaphragm 86 is breached, liquid fuel will be delivered into vacuum chamber 84 at relatively high pressure. Accordingly, a relatively small amount of liquid fuel under pressure will flow from vacuum port 66 into intake manifold 20 through restricted flow port 118, internal passage 108, actuator chamber 110, and port 119. However, because of the flow restriction in the path through restricted flow port 118, fuel will flow at a higher rate into actuator chamber 112. This causes an increase in the differential pressure between the vacuum chamber 84 and the intake manifold 20. When the differential pressure exceeds a predetermined level (substantially instantaneous if a breach of the diaphragm occurs) the pressure on the spool member 96 is unbalanced against the force of the springs line 114 and 116. The relatively high pressure exerted by this flow on end 106 of spool member 96 will shift spool member 96 rightwardly as shown in FIG. 2. In this closed position, annulus 98 no longer aligns with restricted flow port 118 thereby cutting off flow from the fuel contaminated vacuum chamber 84 to intake manifold 20.

This concludes the description of an embodiment which the invention claimed herein is used to advantage. Those skilled in the art will bring to mind many modifications and alterations to the example presented herein without departing from the spirit and scope of the invention. For example, it is contemplated that other simpler null-force balance devices, such as a check valve assembly, may alternatively be used in place of the specific embodiment of the pressure responsive blocking device described herein. Accordingly, it is intended that the invention be limited only by the following claims.

What is claimed:

1. In a fuel injection system having a source of liquid fuel under pressure in fluid communication with at least one fuel injector mounted in an engine intake manifold and a pressure regulator having a first pressure chamber in fluid communication with the source of pressurized fuel, a second pressure chamber in fluid communication with the intake manifold, and a diaphragm sealingly engaged therebetween, the diaphragm maintaining a predetermined pressure differential between the pressure chambers; an apparatus operatively connected between the second pressure chamber and the intake manifold to sense when a pressure differential between the second pressure chamber and the intake manifold is above a predetermined level and, in such an event, to responsively block the fluid communication between the second pressure chamber and the intake manifold.

2. The apparatus according to claim 1 comprising valve means arranged fluidly in series between the second pressure chamber and the intake manifold.

3. The apparatus according to claim 2 wherein said valve means comprises a cavity and a movable valve member having first and second ends received in said cavity, first and second actuator chambers defined by said first and second ends of said valve member and said cavity, respectively, one of said actuator chambers being in direct fluid communication with the intake manifold.

4. The apparatus according to claim 3 wherein said valve member is an elongated spool member.

5. The apparatus according to claim 3 wherein said second pressure chamber is in fluid communication through said valve member with said one actuator chamber and directly with said other actuator chamber, and wherein said valve member is movable in response to a difference in pressure between said one actuator chamber and said other actuator chamber to block fluid communication between said second pressure chamber and said one actuator chamber.

6. The apparatus according to claim 4 wherein said second pressure chamber is in fluid communication through said valve member with said one actuator chamber and directly with said other actuator chamber, and wherein said spool member is movable in response to a difference in pressure between said one actuator chamber and said other actuator chamber to block fluid communication between said second pressure chamber and said one actuator chamber.

7. The apparatus according to claim 6 wherein said spool member being movable between a first open position effecting communication between said second pressure chamber and said one actuator chamber, and a second blocking position preventing said fluid communication between said second pressure chamber and said one actuator chamber.

8. A fuel injection system for an engine having an intake manifold comprising:

a fuel pump providing pressurized fuel;

at least one fuel injector in fluid communication with said fuel pump;

a pressure regulator having a first pressure chamber in fluid communication with said fuel pump, a second pressure chamber in fluid communication with the intake manifold, and a pressure responsive element interposed therebetween; said pressure responsive element maintaining a predetermined pressure differential between said pressure chambers; and a pressure responsive blocking device interposed between said second pressure chamber and the intake manifold for sensing when a pressure differential between said second pressure chamber and said intake manifold is above a predetermined level and responsively blocking said fluid communication between said second pressure chamber and said intake manifold.

9. A fuel injection system according to claim 8 wherein said pressure responsive blocking device comprises valve means arranged fluidly in series between said second pressure chamber and the intake manifold.

10. A fuel injection system according to claim 9 wherein said valve means includes a movable valve member; said movable valve member movable between a first open position effecting fluid communication between said second pressure chamber and the intake manifold and a second blocking position preventing said fluid communication between said second pressure chamber and the intake manifold.

11. A fuel injection system according to claim 10 wherein said pressure responsive element of said pressure regulator normally blocks fluid communication between said fuel pump and the intake manifold and said valve member moves to said second blocking position upon failure of said pressure responsive element to block said fluid communication between said fuel pump and the intake manifold.

12. In a fuel injection system having a source of liquid fuel under pressure in fluid communication with at least one fuel injector mounted in an engine intake manifold and a pressure regulator having a liquid fuel chamber in fluid communication with the source of pressurized fuel, a vacuum chamber in fluid communication with the intake manifold, and a diaphragm sealingly engaged therebetween, the diaphragm maintaining a predetermined pressure differential between the liquid fuel chamber and vacuum chamber; an apparatus fluidly connected between the vacuum chamber and the intake manifold to sense and react to a pressure differential between the vacuum chamber and the intake manifold being above a predetermined level to prevent a flow of fuel through the vacuum chamber to the intake manifold in response to a failure in the diaphragm comprising:

a housing;

a cavity defined by interior walls of said housing;

a spool member having first and second ends slidably disposed in said cavity; and first and second actuator chambers defined between said first and second ends of said spool member and said interior walls of said housing, respectively.

13. An apparatus according to claim 12 wherein said spool member is movable between an open position effecting fluid communication between the intake manifold and the vacuum chamber, and a closed position preventing said fluid communication between the intake manifold and the vacuum chamber.

14. An apparatus according to claim 13 further comprising first and second springs disposed in said first and second actuator chambers, respectively, for balancing said spool member in said open position.

15. An apparatus according to claim 13 wherein said spool member further includes an internal passage for effecting fluid communication between said first actuator chamber and the vacuum chamber when said spool member is in said open position.

16. An apparatus according to claim 13 wherein said spool member moves between said open position and said closed position in response to the pressure differential between the vacuum chamber and the intake manifold being above a predetermined level.

17. An apparatus according to claim 13 wherein first and second parallel fluid paths interconnect said first actuator chamber with the vacuum chamber and said second actuator chamber with the vacuum chamber when said spool member is in said open position, respectively.

18. An apparatus according to claim 17 wherein a flow through said first parallel fluid path is restricted relative to a flow through said second parallel fluid path.

19. An apparatus according to claim 17 further comprising a vacuum distributor for providing said parallel fluid paths.

20. A system as in claim 1, wherein said apparatus prevents a flow of fuel between said second pressure chamber to said intake manifold when said pressure differential between them is due to a leak of fuel from the first pressure chamber to the second pressure chamber.

* * * * *